US007037011B1

(12) United States Patent
Forest et al.

(10) Patent No.: US 7,037,011 B1
(45) Date of Patent: May 2, 2006

(54) RIBBON CARTRIDGE HAVING UPDATABLE DATA COMMUNICATION COMPONENT

(75) Inventors: Scott T. Forest, Hope, NJ (US); Armando Lopez, Santa Ana, CA (US); Albert Van Grouw, III, North Haledon, NJ (US)

(73) Assignee: Amano Cincinnati, Inc., Roseland, NJ (US)

( * ) Notice: Subject to any disclaimer, the term of this patent is extended or adjusted under 35 U.S.C. 154(b) by 0 days.

(21) Appl. No.: 11/176,115

(22) Filed: Jul. 7, 2005

(51) Int. Cl.
*B41J 35/28* (2006.01)
*B41J 3/00* (2006.01)

(52) U.S. Cl. ..... 400/208; 101/93.04

(58) Field of Classification Search ..... 400/208, 400/249, 247; 101/93.04; 347/85, 23, 19, 347/7, 14
See application file for complete search history.

(56) References Cited

U.S. PATENT DOCUMENTS

| | | | | |
|---|---|---|---|---|
| 4,797,016 | A | 1/1989 | Lahr | 200/167 |
| 5,051,719 | A | 9/1991 | Gaston et al. | 338/162 |
| 5,289,242 | A | 2/1994 | Christensen et al. | 399/12 |
| 5,385,416 | A | 1/1995 | Maekawa et al. | 400/208 |
| 5,385,625 | A | 1/1995 | LaFreniere | 156/379.8 |
| 5,504,510 | A | 4/1996 | Miyakawa | 347/85 |
| 5,506,611 | A | 4/1996 | Ujita et al. | 347/19 |
| 5,699,091 | A | 12/1997 | Bullock et al. | 347/19 |
| 5,755,579 | A | 5/1998 | Yanase et al. | 439/76.2 |
| 5,757,394 | A | 5/1998 | Gibson et al. | 347/19 |
| 5,812,156 | A | 9/1998 | Bullock et al. | 347/19 |
| 5,835,817 | A | 11/1998 | Bullock et al. | 399/25 |
| 5,970,273 | A | 10/1999 | Zenk et al. | 399/12 |
| 6,009,285 | A | 12/1999 | Barry et al. | 399/12 |
| 6,019,449 | A * | 2/2000 | Bullock et al. | 347/14 |
| 6,019,461 | A * | 2/2000 | Yoshimura et al. | 347/86 |
| 6,025,993 | A | 2/2000 | Wakabayashi et al. | 361/705 |
| 6,065,824 | A | 5/2000 | Bullock et al. | 118/719 |
| 6,106,166 | A | 8/2000 | Spurr et al. | 396/578 |
| 6,113,208 | A | 9/2000 | Benjamin et al. | 347/7 |
| 6,126,265 | A | 10/2000 | Childers et al. | 347/23 |
| 6,128,448 | A | 10/2000 | Arcaro et al. | 399/27 |
| 6,152,625 | A | 11/2000 | Oliverio | 400/247 |
| 6,155,664 | A | 12/2000 | Cook | 347/7 |
| 6,161,915 | A | 12/2000 | Bolash et al. | 347/19 |
| 6,169,860 | B1 | 1/2001 | Curry et al. | 399/12 |
| 6,312,083 | B1 * | 11/2001 | Moore | 347/19 |
| 6,631,967 | B1 * | 10/2003 | Saruta | 347/19 |
| 6,767,147 | B1 | 7/2004 | Jakubowski et al. | 400/249 |
| 6,904,842 | B1 * | 6/2005 | Jakubowski et al. | 101/93.04 |
| 6,969,140 | B1 * | 11/2005 | Saruta | 347/19 |

OTHER PUBLICATIONS

IBM Technical Disclosure Bulletin, NB 84124203, (Dec. 1984) vol. 27, Issue No. 7B, p. 4203.

* cited by examiner

*Primary Examiner*—Daniel J. Colilla
*Assistant Examiner*—Wasseem H. Hamdan
(74) *Attorney, Agent, or Firm*—Stetina Brunda Garred & Brucker

(57) ABSTRACT

A tape ribbon cartridge and method are provided for regulating printer operation of a printer operative to transmit a download signal. The cartridge includes a housing, an ink ribbon, and a data communication component. The ink ribbon is disposed within the housing. The data communication component is disposed upon the housing and includes operational information being representative of at least one attribute of the ink ribbon. The data communication component is operative to receive the download signal and to provide the operational information to the printer in response thereto. The operational information is receivable by the printer and is utilizable to determine the printer operation.

32 Claims, 5 Drawing Sheets

RIBBON CARTRIDGE HAVING UPDATABLE DATA COMMUNICATION COMPONENT

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The present invention relates generally to printer cartridge products and more specifically, to a uniquely configured tape ribbon cartridge specifically adapted for regulating printer operation utilizing a data communication component.

Dot matrix printer assemblies utilize ribbon cartridges that contain continuous strip of material impregnated with an ink solution. The ribbon is contained in a cartridge container that normally mounts around the dot matrix printer's print head. As the ribbon passes between the printer head and a sheet of paper, the print head selectively forces the ribbon against the paper in order to print information onto the sheet of paper.

In order to print the information, small rods or pins in the printer head are thrust into the ribbon, which then makes contact with the paper adjacent the pins, thereby transferring ink from the ribbon to the paper. Through the proper combination and configuration of pins (the head of each marking a dot), the ink transferred is transformed into recognizable letters or symbols. Typically, the higher the impact force of the pins on the ribbon the darker the resulting image. Many printers commonly produce a consistent impact force.

As the printer assembly moves across the sheet of paper, the ribbon, which is formed as a continuous band, is also pulled laterally across the gap between the paper and the print head, continuously providing a new ink-impregnated ribbon area to be struck by the pins for the printing operation, and pulling the used ribbon area away from the print head. If the ribbon does not move continuously, the ribbon and the ink impregnation would likely wear out quickly in response to repetitive striking of the same area.

Recent developments in dot matrix printers allow the cartridge to carry specific information used to retrieve operational parameters from an external database. As noted in U.S. Pat. No. 6,767,147 and U.S. Pat. No. 6,904,892, a method and apparatus are disclosed for adaptively controlling printer operation of a dot matrix printer in response to sensing a resistive value of a cartridge corresponding to a attribute of the ink ribbon or the cartridge installed therein. Under the teachings of those documents, the printer obtains the resistive value from a resistive ink identifier disposed upon the ink cartridge. At that point, the printer accesses an external database and uses the resistive value to obtain an operational parameter from the external database.

Using the aforementioned method and apparatus, the printer first obtains the resistive value from the cartridge and then utilizes the resistive value to retrieve the operational parameters from a source external to the cartridge. However, this configuration does not allow the printer or cartridge to update operational parameters in response to printer usage. Additionally, such a configuration requires the printer to access operational parameters found only in an external database. Furthermore, the printer or its external database would need to be updated in order to supply new information regarding each new cartridge, which might be a difficult and time-consuming step.

Thus there exists a need in the art to provide a ribbon cartridge that tends to simplify and better facilitate the providing of operational information to a printer. There is a need in the art to provide a method in which the operational information may be supplied to the printer reducing the risk of requiring modification of the printer or other components in order to do so. Finally, there is a need in the art to provide a convenient method and apparatus for providing and updating the operational information corresponding to a given cartridge.

BRIEF SUMMARY OF THE INVENTION

A tape ribbon cartridge is provided for regulating printer operation. The printer is operative to transmit a download signal. The cartridge comprises a housing, an ink ribbon, and a data communications component. The ink ribbon is disposed within the housing. The data communication component is disposed upon the housing and includes operational information being representative of at least one attribute of the ink ribbon. The data communication component is operative to receive the download signal and to provide operational information in response thereto. The operational information is receivable by the printer and utilizable to determine the printer operation.

The data communication component may be a computer chip. The operational information may be selected from the group consisting of stroke length, impact force, pulse width, relative ink density, length of the ink ribbon, thickness of the ink ribbon, and number of key strokes. When the printer is operative to transmit an update signal being representative of completed operations of the printer, the data communication component may be operative to receive the update signal and to update the operational information in response to the thereto. Thus, the data communication component may update the operational information in response to the completed operations of the printer.

The cartridge may further include a completion register being operative to transmit a register signal. The register signal may be representative of completed operations of the printer. The data communication component may be operative to receive the register signal and to update the operational information in response thereto. The data communication component may be color-coded to indicate at least one attribute of the ink ribbon. When the printer includes a cartridge seat defining a unique physical shape, the housing may be sized and configured being at least partially disposed within the unique physical shape of the cartridge seat of the printer.

Also provided is a method for selectively regulating printer operation of a printer. The method comprises: transmitting a download signal to a data communication component disposed upon a tape ribbon cartridge, the data communication component including operational information being representative of at least one attribute of the cartridge; utilizing the data communication component to receive the download signal and to provide operational information to the printer in response thereto; receiving the operational information at the printer, the operational information being utilizable to determine the printer operation; and regulating printer operation in response to the operational information.

The data communication component may be a computer chip. The operational information may be selected from the group consisting of stroke length, impact force, pulse width, relative ink density, length of the ink ribbon, thickness of the ink ribbon, and number of key strokes. The method may further include updating the operational information in the data communication component in response to the completed operations of the printer. The method may further include transmitting an update signal to the data communication component, the update signal being representative of completed operations of the printer; receiving the update signal at the data communication component; and updating the operational information included in the data communication component in response to the update signal.

The method may further include transmitting a register signal from a completion register to the data communication component, the completion register being disposed upon the cartridge and being operative to transmit the register signal being representative of completed operations of the printer; receiving the register signal at the data communication component; and updating the operational information included in the data communication component in response to the register signal.

The step of regulating printer operation may comprise: sensing printer usage data on an ongoing basis; and varying printer operation in response to the sensed printer usage data. The printer usage data may be included within the download signal. The step of sensing printer usage data may comprise sensing the number of characters which have been printed by the printer. The step of varying printer operation may comprise the step of regulating print head impact force in response to sensed printer usage data.

BRIEF DESCRIPTION OF THE DRAWINGS

An illustrative and presently preferred embodiment of the invention is shown in the accompanying drawings in which.

DETAILED DESCRIPTION OF THE INVENTION

Figure 1:
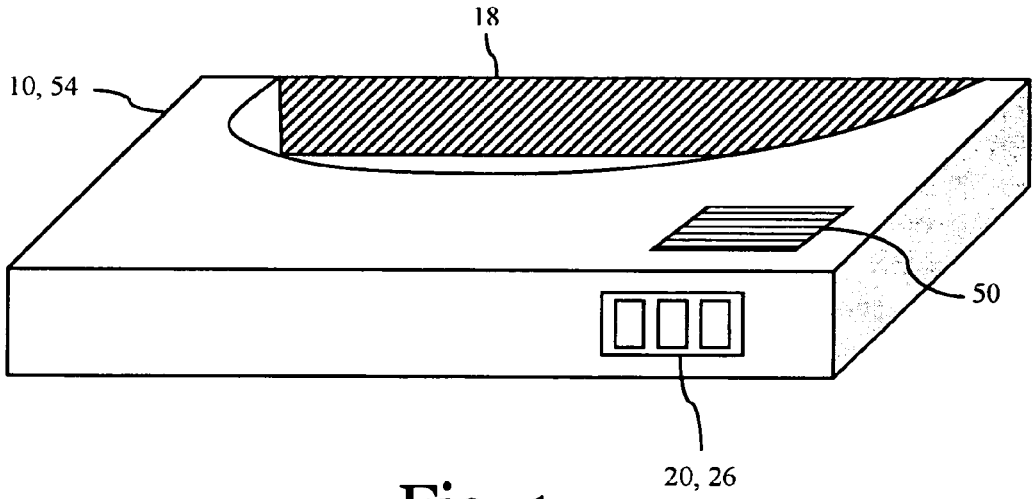
FIG. 1 illustrates an exemplary embodiment of a tape ribbon cartridge including a housing, an ink ribbon, a data communication component, and a completions register.
Figure 2:
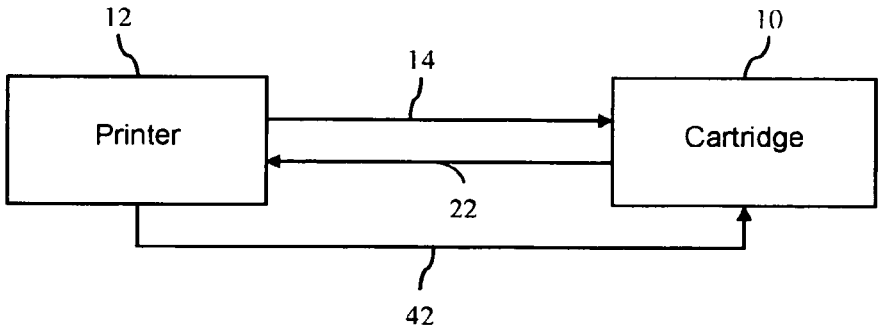
FIG. 2 is a block diagram illustrating the functional relationship of the printer and the data communication component, illustrating the signals transmittable therebetween.

Referring now to the drawings wherein the showings are for purposes of illustrating the preferred embodiment of the present invention only and not for purposes of limiting the same, FIG. 1 is a front perspective view of a tape ribbon cartridge 10 in accordance with an aspect of the present invention. The tape ribbon cartridge 10 is provided for regulating printing operation. As shown in FIGS. 1 and 2, a printer 12 is operative to transmit a download signal 14, and the cartridge comprises a housing 16; an ink ribbon 18 being disposed within the housing 16; and a data communication component 20 being disposed upon the housing 16 and including operational information 22 being representative of at least one attribute of the ink ribbon 18, the data communication component 20 being operative to receive the download signal 14 and to provide operational information 22 in response thereto, the operational information 22 and being receivable by the printer 12, the operational information 22 being utilizable to determine the printer operation.

According to an aspect of the present invention, and as illustrated in FIG. 1, the data communication component 20 may be a computer chip 26. As shown in FIG. 1, the data communication component 20 is disposed upon the housing 16 in order to facilitate communication with the printer 12. The printer 12 may communicate directly with the data communication component 20. The printer 12 may also communicate indirectly with the data communication component 20 via a data communication port such as electrical contact or the like. Therefore, the data communication component 20 may be disposed upon the housing 16 within a protective enclosure such that the data communication port allows the printer 12 to communicate freely with the data communication component 20. In some cases, the data communications component 20 may communicate wirelessly with the printer 12. In other cases, it is contemplated that the data communication component 20 may be integrated or combined with other devices or operational equipment.

The data communication component 20 includes the operational information 22. It is contemplated that the operational information 22 may be contained within the data communication component 20 and that the operational information 22 may be alterable within the data communication component 20. Thus, in an exemplary embodiment of the present invention, the data communication component 20 may be the computer chip 26 capable of providing and storing information thereon.

The data communication component 20 may be configured to include data writing and memory storage capability. Further, the data communication component 20 may be operative to send and receive various data, such as the operational information 22. In accordance with an embodiment of the present invention, the data communication component 20 may be configured to include an internal power source. However, the data communication component 20 may also receive power from an external source, and/or operate as a transponder. Further, the data communication component 20 may be configured to be in communication with sensors disposed about the housing for receiving data therefrom regarding the operation of the cartridge 10 and/or the ink ribbon 18.

Figure 3:
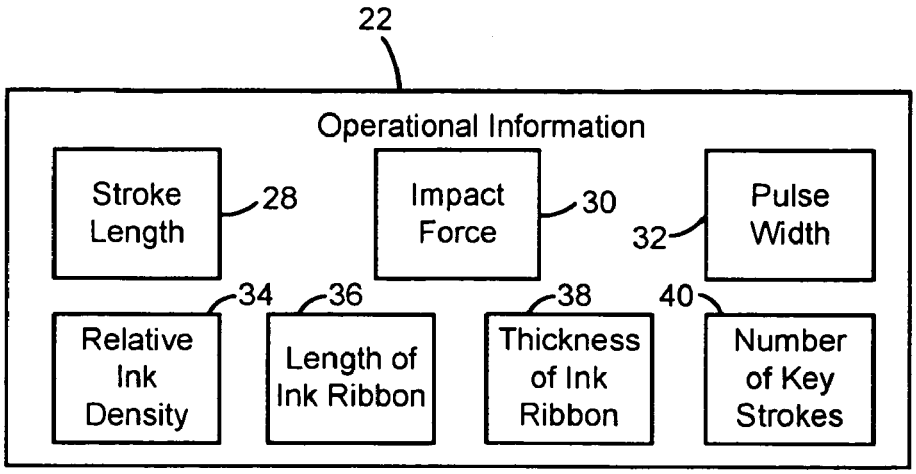
FIG. 3 is a diagram illustrating exemplary components of operational information.

The operational information 22 is representative of at least one attribute of the ink ribbon 18. As illustrated in FIG. 3, the operational information 22 may include information such as stroke length 28, impact force 30, pulse width 32, relative ink density 34, length of the ink ribbon 36, thickness of the ink ribbon 38, and number of key strokes 40, all of which may be attributes of the ink ribbon 18. Nevertheless, it is contemplated that additional information representing other attributes of the ink ribbon 18 may be included within the operational information 22, such as the absorption capacity of the ink ribbon 18, drying characteristics, quality characteristics, strength properties of the ink ribbon 18, and the like.

Referring again to FIG. 2, the data communication component 20 is operative to receive the download signal 14 and to provide the operational information 22 in response thereto. The operational information 22 is receivable by the printer 12. The data communication component 20 may interact with the printer 12 to provide the printer 12 with the operational information 22. Additionally, the data communication component 20 may transmit the operational information 22 to the printer 12. In an exemplary embodiment, the printer 12 may transmit the download signal 14 to the cartridge when the cartridge is initially installed or when the printer 12 is turned on and/or off. This interaction may allow the printer 12 to be updated prior to performing a printing operation. Nevertheless, the download signal 14 may also be selectively transmitted to the data communication component 20 at any time for purposes of obtaining the operational information 22 from the data communication component 20.

In response to the download signal 14, the data communication component 20 transmits the operational information 22. The operational information 22 may be sent automatically immediately after receiving the download signal 14. However, the operational information 22 may be sent in response to other conditions, such as user preference or at the initiative of the data communication component 20 as in a periodic update. The operational information 22 may be in a usable format for the printer 12 such that the printer 12 may be operative to read and utilize the operational information 22. It is contemplated that the operational information 22 may include other desired information which may be required to utilize or adapt the operational information 22 (which is collectively referred to as operational information 22), and that all such information may be transmitted to the printer 12. Thus in an embodiment, the operational information 22 may be utilized by the printer 12 to determine the printer operation. For example, the operational information 22 may be utilized to control printer operation such as the number of characters printed, length of ink ribbon used, impact force of a print head, and pulse width, to name a few.

Figure 4:
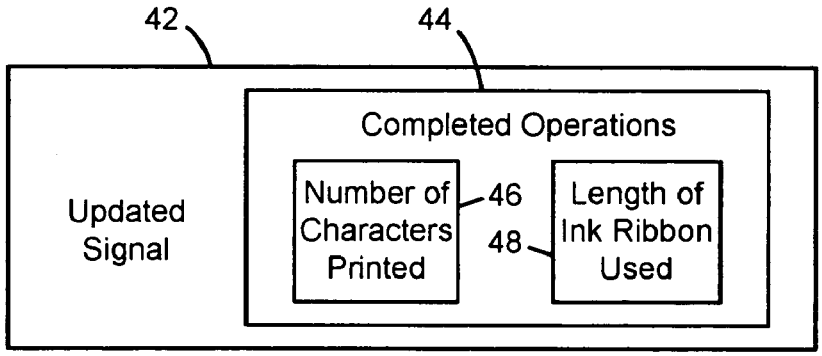
FIG. 4 is a diagram illustrating exemplary components of an update signal and of completed operations includable therein.

As illustrated in FIG. 2, when the printer 12 is operative to transmit an update signal 42 as being representative of completed operations 44 of the printer 12, the data communication component 20 may be operative to receive the update signal 42 and to update the operational information 22 in response thereto. Referring now to FIG. 4, the completed operations 44 of the printer 12 may include information such as the number of characters printed 46, the length of ink ribbon 36 used, the impact force 30, the pulse width 32, and other factors related to the operations of the printer 12. In response to the update signal 42, the data communication component 20 may be able to update the operational information 22 in accordance with the completed operations 44 of the printer 12. In this regard, it is contemplated that the operational information 22 may be frequently updated so as to be accurate each time that the operational information 22 is transmitted by the data communication component 20. This updating ability may therefore allow the printer 12 to continually adapt to the changing attributes of the ink ribbon 18. For example, the printer 12 may transmit the download signal 14 multiple times during a printing operation. During the printing operation, it is contemplated that the update signal 42 may also be sent to the data communication component 20 and that the operational information 22 will be updated in response to the completed operations 44 of the printer 12. Therefore, during printer operation, it is contemplated that with the transmission and receipt of the signals, the printer 12 may continually be able to adapt to the changing attributes of the ink ribbon 18 in order to optimize printer performance and to optimize use of the cartridge and ink ribbon 18.

In accordance with another aspect of the present invention, it is contemplated that the operational information 22 may be specific to a given cartridge. Cartridges may come in several different shapes and sizes depending upon the printer requirements. As is common, cartridges may often be replaced within the same printer frequently. For example, a cartridge may be removed and replaced temporarily by another cartridge due to certain requirements by a user. When this happens, both of these cartridges may require different operational parameters in order to optimize printer operation. Therefore, in accordance with an aspect of the present invention, each of these cartridges may include the data communication component 20 that may include distinct operational information 22 related to the respective cartridges. In this regard, the printer 12 need not access an external database in order to obtain the operational information 22 for the cartridges. Nor must the printer 12 utilize additional printer hardware or software in order to provide all such operational information 22 itself. Thus, even when new cartridges are released, the printer 12 may receive the operational information 22 directly from the new cartridge. According to one implementation of the present invention, the printer 12 may never need to be updated in order to obtain the operational information 22 for new or different cartridges. Instead, the data communication component 20 for a given cartridge may contain operational information 22 corresponding to the given cartridge.

Figure 5:
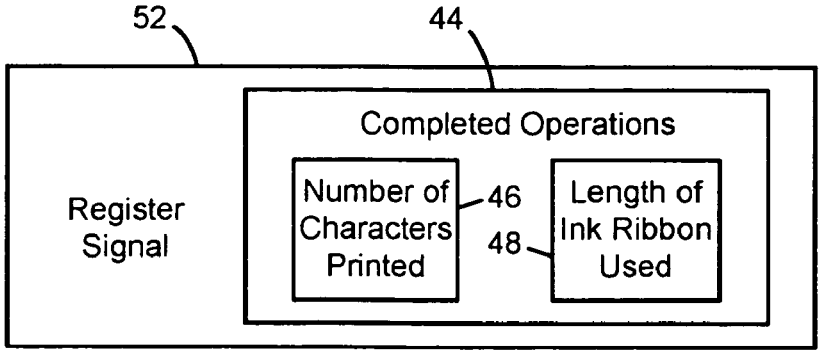
FIG. 5 is a diagram illustrating exemplary components of a register signal and of completed operations includable therein.

The data communication component 20 may update the operational information 22 in response to the completed operations 44 of the printer 12. As shown in FIGS. 1 and 5, the cartridge may further include a completion register 50 being operative to transmit a register signal 52 being representative of the completed operations 44 of the printer 12, the data communication component 20 being operative to receive the register signal 52 and to update the operational information 22 in response thereto. Referring again to FIG. 1, the completion register 50 may be disposed upon the housing 16 of the cartridge. The register signal 52 may be transmitted directly or indirectly to the data communication component 20. Although the completion register 50 is shown in FIG. 1 as being separate from the data communication component 20, it is contemplated that the data communication component 20 and the completion register 50 may be integrated into a single unit.

The completion register 50 may monitor at least one attribute of the ink ribbon 18. As exemplified in FIG. 5, the completion register 50 may monitor the length of the ink ribbon 18 used, the relative ink density 34, quantity of ink remaining in the cartridge, and other printing operation parameters. In addition, the completion register 50 may also monitor the quantity and frequency of printing operations, and other aspects of the completed operations 44 mentioned herein. The completion register 50 may be contained within the cartridge and communicate directly with the data communication component 20 via the register signal 52. The register signal 52 may be sent intermittently or selectively such that the data communication component 20 may update the operational information 22 in response thereto. Utilization of the completion register 50 may thus not require that the printer 12 transmit the update signal 42 to the data communication component 20 in order to update the operational information 22. However, it is contemplated that the completion register 50 be utilized in conjunction with or in response to the update signal 42 as transmitted from the printer 12. In one embodiment of the present invention, the update signal 42 may be received by the completion register 50 and the register signal 52 may be sent in response thereto, and include all pertinent information regarding completed operations 44 of the printer 12. Therefore, the data communication component 20 may update the operational information 22 in response to the completed operations 44 of the printer 12.

In accordance with another aspect of the present invention, the data communication component 20 may be color coded to indicate at least one attribute of the ink ribbon 18. It is contemplated that this attribute of the data communication component 20 may be useful by the printer 12 or the user in order to determine at least one attribute of the ink ribbon 18. Where the printer 12 includes the cartridge seat defining a unique physical shape 54, the housing 16 may be sized and configured to be at least partially disposed within the unique physical shape 54 of the cartridge seat of the printer 12. Therefore, the housing 16 may define a unique physical shape 54 matable to the unique physical shape 54 of the cartridge seat. This structural attribute of the housing 16 may enable the printer 12 and the user alike to determine the compatibility of the cartridge with the printer 12, or may allow the printer 12 or user to determine at least one attribute of the ink ribbon 18.

Figure 6:
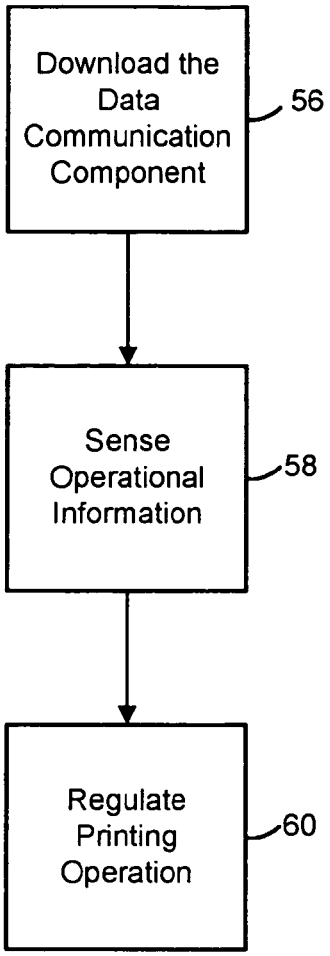
FIG. 6 is a block diagram illustrating an exemplary embodiment of a methodology of regulating printer operation.

In accordance with another aspect of the present invention, a method is provided for selectively regulating printer operation. FIG. 6 illustrates a, basic formulation of this method wherein a data communication component 20 is queried (i.e., query step 56, as shown in FIG. 6), operational information 22 is sensed (i.e., sense operational information step 58, as shown on FIG. 6), and printing operation is regulated in response to the sensed operational information 22 (i.e., regulate printer operations in response to sensing step 60, as shown on FIG. 6).

Figure 7:
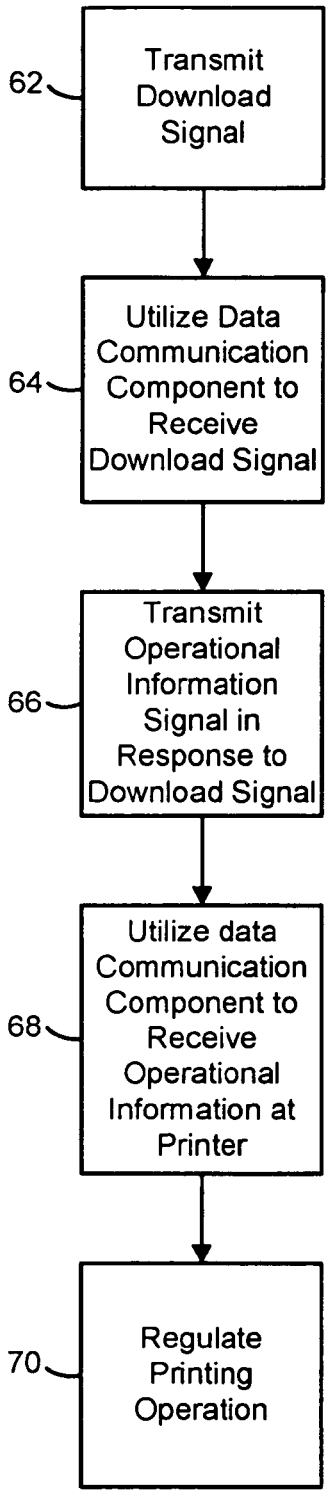
FIG. 7 is a block diagram illustrating an exemplary embodiment of a methodology of regulating printer operation wherein a download signal is transmitted to the data communication component, and in response thereto, the data communication component transmits the operational information to the printer.

As illustrated in FIG. 7, an implementation of the method of the present invention may comprise the steps of transmitting a download signal 14 to the data communication component 20 disposed upon a tape ribbon cartridge 10 (i.e. transmit download signal step 62, as shown in FIG. 7), the data communication component 20 including the operational information 22 being representative of at least one attribute of the cartridge; utilizing the data communication component 20 to receive the download signal 14 (i.e., utilize data communication component step 64, as shown in FIG. 7) and to provide operational information 22 to the printer 12 in response to the download signal 14 (i.e., provide operational information step 66, as shown in FIG. 7); receiving the operational information 22 at the printer 12 (i.e., receive operational information step 68, as shown in FIG. 7), the operational information 22 being utilizable to determine the printer operation; and regulating printing operation in response to the operational information 22 (i.e., regulate printer operation in response to operational information step 70, as shown in FIG. 7).

As illustrated in FIG. 1, the data communication component 20 may be a computer chip 26. As shown in FIG. 3, the operational information 22 may include stroke length 28, impact force 30, pulse width 32, relative ink density 34, length of the ink ribbon 36, thickness of the ink ribbon 38, and number of key strokes 40, as well as other operational parameters related to a attribute of the ink ribbon 18.

Figure 8:
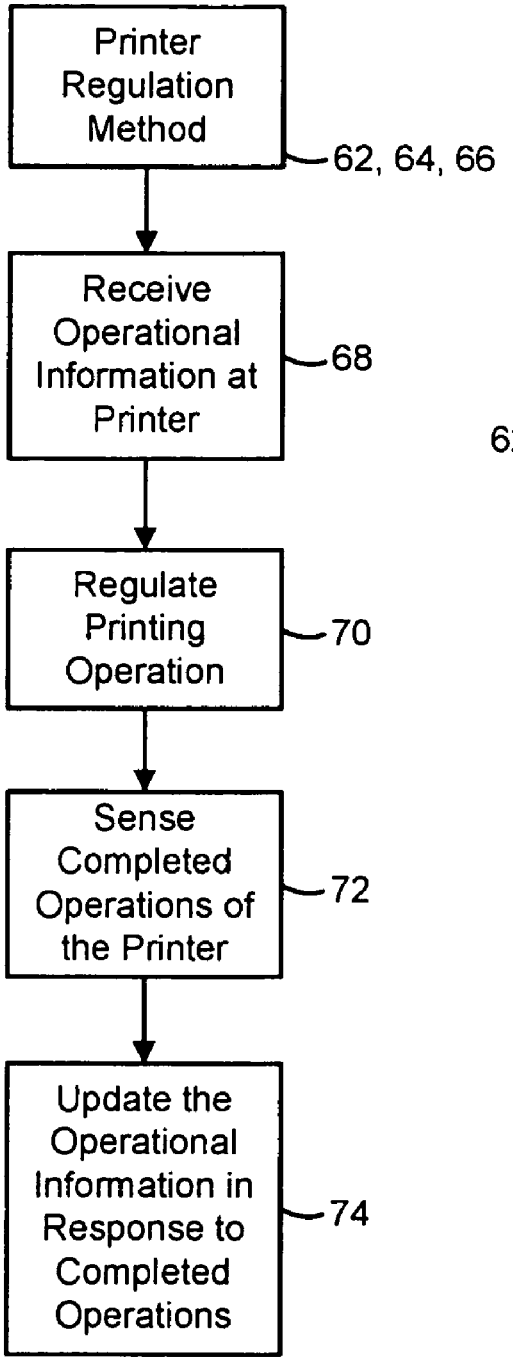
FIG. 8 is a block diagram illustrating an exemplary embodiment of a methodology of regulating printer operation wherein the competed operations of the printer are sensed and the operational information is updated in response thereto.

Referring now to FIG. 8, the method may further include the steps of sensing the completed operations 44 of the printer 12 (i.e., sense completed operations step 72, as shown in FIG. 8) and updating the operational information 22 of the data communication component 20 in response to thereto (i.e., update in response to completed operations step 74, as shown in FIG. 8). It is contemplated that the updating step 74 may be performed at any time during the method, either prior to or after the transmission of the download signal 14 or the operational information 22. In one embodiment, the operational information 22 may be updated after each completed operation of the printer 12. At that time, the printer 12 may transmit the download signal 14 to the data communication component 20, the data communication component 20 may receive the download signal 14, and in response thereto, the data communication component 20 may provide the operational information 22 to the printer 12.

Figure 9:
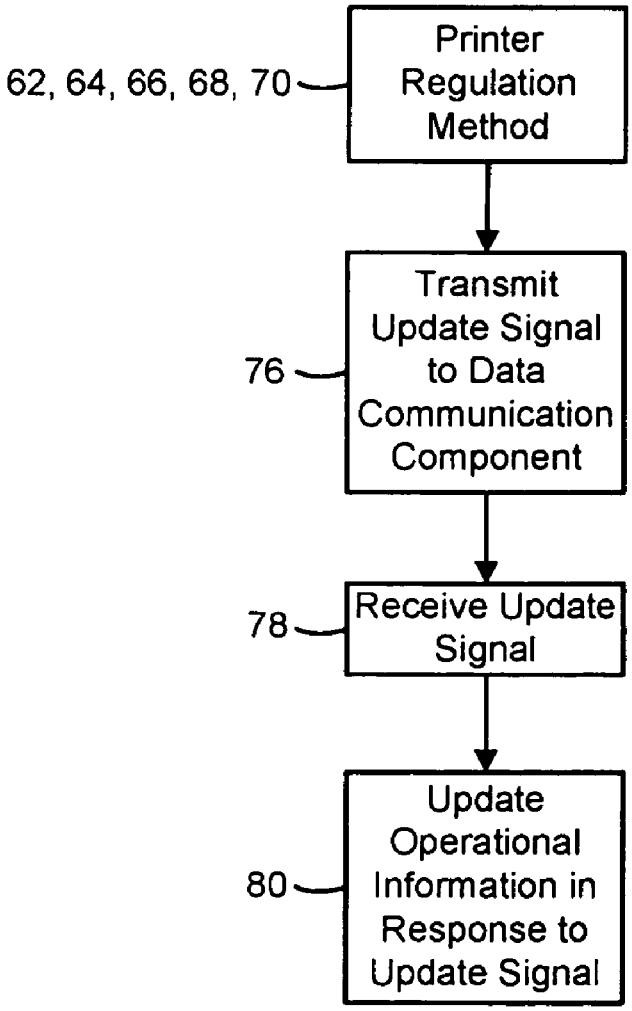
FIG. 9 is a block diagram illustrating an exemplary embodiment of a methodology of regulating printer operation wherein the update signal is transmitted to the data communication component and the operational information is updated in response thereto.

In another embodiment of the present invention, shown illustratively in FIG. 9, the method may include the steps of transmitting an update signal 42 to the data communication component 20 (i.e., transmit update signal step 76, as shown in FIG. 9), the update signal 42 being representative of the completed operations 44 of the printer 12; receiving the update signal 42 at the data communication component 20 (i.e., receive update signal step 78, as shown in FIG. 9); and updating the operational information 22 included in the data communication component 20 in response to the update signal 42 (i.e., update in response to update signal step 80, as shown in FIG. 9). The update signal 42 may be transmitted to the data communication component 20 independent of the transmission of the download signal 14 or the operational information 22. However, it is contemplated that the transmission of the update signal 42 may be coordinated with the transmission of the operational information 22 and/or the download signal 14 such that the data communication component 20 regulates printing operation. The transmission of all signals may be configured and organized to optimize printer operation.

Figure 10:
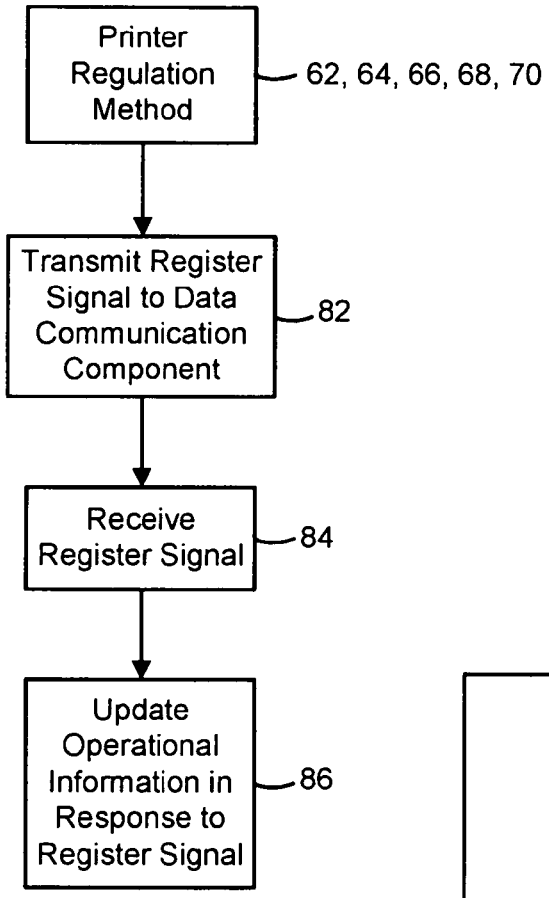
FIG. 10 is a block diagram illustrating an exemplary embodiment of a methodology of regulating printer operation wherein the register signal is transmitted to the data communication component and updating the operational information in response thereto.

Referring now to FIG. 10, according to another implementation of the present invention, the method may include the steps of transmitting a register signal 52 from a completion register 50 to the data communication component 20, the completion register 50 being disposed upon the cartridge and being operative to transmit the register signal 52 (i.e., transmit register signal step 82, as shown in FIG. 10) being representative of completed operations 44 of the printer 12; receiving the register signal 52 at the data communication component 20 (i.e., receive register signal step 84, as shown in FIG. 10); and updating the operational information 22 included in the data communication component 20 in response to the register signal 52 (i.e., update in response to register signal step 86, as shown in FIG. 10). As mentioned herein, the register signal 52 may be transmitted from the completion register 50 in response to the download signal 14, the operational information 22 or the update signal 42. Additionally, the transmission of the register signal 52 may also be coordinated with the transmission of the operational information 22, the download signal 14, and/or the update signal 42 in order to optimize printer operation.

Figure 11:
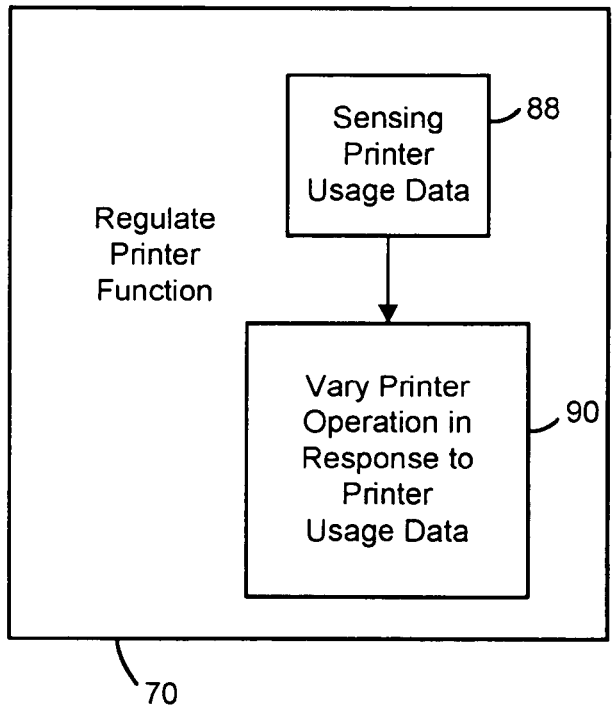
FIG. 11 is a block diagram illustrating an exemplary embodiment of a regulating printer operation step wherein printer usage data is sensed on an ongoing basis and printer operations are varied in response thereto.

As illustrated in FIG. 11, in accordance with another aspect of the present invention, the method step of regulating printer operation may comprise sensing printer usage data on an ongoing basis (i.e., sense printer usage data step 88, as shown in FIG. 11); and varying printer operations in response to the sensed printer usage data (i.e., vary printer operations step 90, as shown in FIG. 11); the printer usage data may be included within the download signal 14. The sense printer usage data step 88 may comprise sensing the number of characters which have been printed by the printer 12. The vary printer operations step 90 may comprise the step of regulating print head impact force 30 in response to sensed printer usage data.

This description of the various embodiments of the present invention is presented to illustrate the preferred embodiments of the present invention, and other inventive concepts may be otherwise variously embodied and employed. The appended claims are intended to be construed to include such variations except insofar as limited by the prior art.

What is claimed is:

1. A tape ribbon cartridge for regulating printer operation, the printer being operative to transmit a download signal, the cartridge comprising:

a housing;

an ink ribbon being disposed within the housing; and a data communication component being disposed upon the housing and including downloadable cartridge operational information being representative of at least one attribute of the ink ribbon, the data communication component being operative to receive the download signal and to provide the operational information to the printer in response thereto, the operational information being utilizable to regulate printer operation, update signal from the printer, the update signal, being representative of completed operations of the printer, the cartridge data communication component being operative to update the cartridge operational information in response thereto.

2. The cartridge of claim 1 wherein the data communication component is a computer chip.

3. The cartridge of claim 1 wherein the operational information is selected from the group consisting of stroke length, impact force, pulse width, relative ink density, length of the ink ribbon, thickness of the ink ribbon, and number of key strokes.

4. The cartridge of claim 1 wherein the data communication component updates the operational information in response to the completed operations of the printer.

5. The cartridge of claim 1 further including a completion register being operative to transmit a register signal to the data communications component, the register signal being representative of ribbon status in response to completed operations of the printer the data communication component being operative to update the operational information in response thereto.

6. The cartridge of claim 1 wherein the data communication component is color-coded to indicate at least one attribute of the ink ribbon.

7. The cartridge of claim 1 wherein the printer includes a cartridge seat defining a unique physical shape, and the housing is sized and configured being at least partially disposed within the unique physical shape of the cartridge seat of the printer.

8. A method for selectively regulating printer operation of a printer, comprising:

receiving a download signal at a data communication component disposed upon a tape ribbon cartridge, the data communication component including operational information being representative of at least one attribute of the cartridge;

providing cartridge operational information to the printer in response to the download signal;

receiving an update signal from the printer, the update signal being representative of completed operations of the printer; and updating the operational information in response to the update signal;

regulating printer operation in response to the operational information.

9. The method of claim 8 wherein the data communication component is a computer chip.

10. The method of claim 8 wherein the operational information is selected from the group consisting of stroke length, impact force, pulse width, relative ink density, length of the ink ribbon, thickness of the ink ribbon, and number of key strokes.

11. The method of claim 8 further including updating the operational information in the data communication component in response to the completed operations of the printer.

12. The method of claim 8 further including:

transmitting a register signal from a completion register to the data communication component, the completion register being disposed upon the cartridge and being operative to transmit the register signal being representative of completed operations of the printer;

receiving the register signal at the data communication component; and updating the operational information included in the data communication component in response to the register signal.

13. The method of claim 8 wherein the step of regulating printer operation comprises:

sensing printer usage data on an ongoing basis; and varying printer operation in response to the sensed printer usage data.

14. The method of claim 13 wherein the printer usage data is included within the download signal.

15. The method of claim 13, wherein the step of sensing printer usage data comprises sensing the number of characters which have been printed by the printer.

16. The method of claim 13, wherein the step of varying printer operation comprises the step of regulating print head impact force in response to sensed printer usage data.

17. A tape ribbon cartridge for regulating printer operation, the printer being operative to transmit a download signal, the cartridge comprising:

a housing;

an ink ribbon being disposed within the housing; and a data communication component being disposed upon the housing and including downloadable cartridge operational information being representative of at least one attribute of the ink ribbon, the data communication component being operative to receive the download signal and to provide the operational information to the printer in response thereto, the operational information being utilizable to regulate printer operation; and a completion register operative to transmit a register signal to the data communications component, the register signal being representative of ribbon status in response to completed operations of the printer, the data communication component being operative to update the operational information in response thereto.

18. The cartridge of claim 17 wherein the data communication component is a computer chip.

19. The cartridge of claim 17 wherein the operational information is selected from the group consisting of stroke length, impact force, pulse width, relative ink density, length of the ink ribbon, thickness of the ink ribbon, and number of key strokes.

20. The cartridge of claim 17 wherein the cartridge is operative to receive an update signal from the printer, the update signal being representative of completed operations of the printer, the cartridge data communication component being operative to update the cartridge operational information in response thereto.

21. The cartridge of claim 20 wherein the data communication component updates the operational information in response to the completed operations of the printer.

22. The cartridge of claim 17 wherein the data communication component is color-coded to indicate at least one attribute of the ink ribbon.

23. The cartridge of claim 17 wherein the printer includes a cartridge seat defining a unique physical shape, and the housing is sized and configured being at least partially disposed within the unique physical shape of the cartridge seat of the printer.

24. A method for selectively regulating printer operation of a printer, comprising:

receiving a download signal at a data communication component disposed upon a tape ribbon cartridge, the data communication component including operational information being representative of at least one attribute of the cartridge;

providing operational information to the printer in response to the download signal;

regulating printer operation in response to the operational information;

transmitting a register signal from a completion register to the data communication component, the completion register being disposed upon the cartridge, the register signal being representative of completed operations of the printer;

receiving the register signal at the data communication component; and updating the operational information included in the data communication component in response to the register signal.

25. The method of claim 24 wherein the data communication component is a computer chip.

26. The method of claim 24 wherein the operational information is selected from the group consisting of stroke length, impact force, pulse width, relative ink density, length of the ink ribbon, thickness of the ink ribbon, and number of key strokes.

27. The method of claim 24 further including updating the operational information in the data communication component in response to the completed operations of the printer.

28. The method of claim 24 further including:

receiving an update signal from the printer, the update signal being representative of completed operations of the printer; and updating the operational information included in the data communication component in response to the update signal.

29. The method of claim 24 wherein the step of regulating printer operation comprises:

sensing printer usage data on an ongoing basis; and varying printer operation in response to the sensed printer usage data.

30. The method of claim 29 wherein the printer usage data is included within the download signal.

31. The method of claim 29, wherein the step of sensing printer usage data comprises sensing the number of characters which have been printed by the printer.

32. The method of claim 29, wherein the step of varying printer operation comprises the step of regulating print head impact force in response to sensed printer usage data.

* * * * *